US006648525B2

(12) United States Patent
Askeland et al.

(10) Patent No.: US 6,648,525 B2
(45) **Date of Patent: *Nov. 18, 2003**

(54) ADAPTIVE INCREMENTAL PRINTING THAT MAXIMIZES THROUGHPUT BY DATA SHIFT TO PRINT WITH PHYSICALLY UNALIGNED NOZZLES

(75) Inventors: Ronald A. Askeland, San Diego, CA (US); William S. Osborne, Camas, WA (US)

(73) Assignee: Hewlett-Packard Development Company, L.P., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/492,929

(22) Filed: Jan. 27, 2000

(65) Prior Publication Data

US 2002/0146263 A1 Oct. 10, 2002

(51) Int. Cl.[7] ..... B41J 9/44

(52) U.S. Cl. ..... 400/70; 400/61; 400/74; 400/76

(58) Field of Search ..... 400/70, 124.08, 400/76, 61, 74; 347/19, 12

(56) References Cited

U.S. PATENT DOCUMENTS 5,250,956 A * 10/1993 Haselby et al. ..... 346/1.1
5,350,929 A * 9/1994 Meyer et al. ..... 250/573
5,480,240 A * 1/1996 Bolash et al. ..... 400/124.01
5,677,716 A 10/1997 Cleveland ..... 347/37
6,089,766 A * 7/2000 Yamada et al. ..... 400/120.09
6,109,722 A * 8/2000 Underwood et al. ..... 347/19
6,154,230 A * 11/2000 Holstun et al. ..... 347/19
6,339,480 B1 * 1/2002 Yamada et al. ..... 358/1.16

FOREIGN PATENT DOCUMENTS

EP 0894634 A2 * 2/1999 ..... B41J/2/51

* cited by examiner

*Primary Examiner*—Charles H. Nolan, Jr.

(57) ABSTRACT

One aspect of the invention checks mechanical misalignment of plural pens and shifts data to allow for at least part of misalignment—and automatically prints images with the shifted data. If pens are aligned within a dot row then preferably the image prints without data shift. In one other preference, the pens print respective ink types; in this regard a particular preference is that the inks include plural colors, or alternatively plural dilutions. The invention is particularly beneficial in printing on a particular printing medium that is insensitive to relative timing of deposition of ink types; in this case an ideal print medium is plain paper. In some such situations the data shift best compensates for only part of misalignment, and pen-nozzle selections for the rest. In other situations the shifting step best compensates for all the misalignment. In another aspect, the invention extends marking element life and thereby printhead life by distributing usage over a maximum number of elements. This is accomplished by a system that checks misalignment and shifts data, as above. Alternative preferences for finding alignment include data encoded on pens and a reader of the encoded data; or a system that uses the pens to print a test pattern and reads it to find alignment. A hardware aspect of the invention includes parts of a processor programmed to check alignment and print with essentially all nozzles, taking alignment into account.

23 Claims, 5 Drawing Sheets

ADAPTIVE INCREMENTAL PRINTING THAT MAXIMIZES THROUGHPUT BY DATA SHIFT TO PRINT WITH PHYSICALLY UNALIGNED NOZZLES

RELATED PATENT DOCUMENTS

A closely related document is another, coowned U. S. utility-patent application filed in the United States Patent and Trademark Office substantially contemporaneously with this document—and also hereby incorporated by reference in its entirety into this document. It is in the names of Askeland et al., and entitled "ADAPTIVE INCREMENTAL-PRINTING MODE THAT MAXIMIZES THROUGHPUT WHILE MAINTAINING INTERPEN ALIGNMENT BY NOZZLE SELECTION"—subsequently assigned utility-patent application Ser. No. 09/492,564, and issued as U.S. Pat. No. 6,435,644 on Aug. 20, 2002.

FIELD OF THE INVENTION

This invention relates generally to machines and procedures for incremental printing of text or graphics on printing media such as paper, transparency stock, or other glossy media; and more particularly to alignment provisions in a scanning machine and method that construct text or images from individual ink spots created on a printing medium, in a two-dimensional pixel array. The invention employs threshold printmode techniques to optimize image quality vs. operating time.

BACKGROUND OF THE INVENTION

The foregoing statement of the field of the invention speaks of "threshold" techniques in the printmode area. This term is used merely to emphasize that the printmode techniques required for practice of the present invention are extremely basic—almost primitive, in comparison with the very sophisticated present state of the printmode or print-masking art.

For example, the related-art section of U.S. Pat. No. 5,677,716 of Cleveland, filed seven years ago, discusses space-rotation, sweep-rotation and autorotation of masks. More-recently filed patent documents introduce manual pseudorandomization, "neighborhood" conditions, balanced randomization and determinism, automatic generation, and real-time generation of printmasks—including columnwise mask generation within each swath, "precooked masks" and "pop-up" masks.

Although entirely compatible with all of the advanced techniques just noted, the present invention by comparison actually needs only the most simple or pedestrian tools of the printmode art—little more, in fact, than the concept of a printmask height. Therefore, as will be seen, these techniques are indeed at the threshold of the print-mode arena; yet their use in the present invention confers potent advantages.

(a) The need for registration—Many incremental printers use more than one array of multiple printing elements, such as for example multipen inkjet printers. Most often the different arrays ("pens" or "printheads") print in different colors, including black; however, in certain cases some of the different arrays print in different dilutions or saturations of common colors. Other uses of plural arrays may occur.

In such printers it is necessary that markings made by the different arrays be in register with one another. At least markings should be adequately registered to prevent a human viewer from seeing—with the unaided eye—the effects of misregistration.

In general, however, such systems are subject to mutual misalignment of the arrays and therefore misregistration of the markings. Various different kinds of provisions are known for reducing such misalignment to the point at which registration at least satisfies visual requirements.

(b) Tight tolerances—For convenience and definiteness such provisions can be described with reference to multipen inkjet printers, and more particularly thermal-inkjet units of the Hewlett Packard Company—such as the models known as PaintJet®, DeskJet® 1200C and HP® 2000C. In some of these printers, alignment is achieved mechanically: the pens are aligned to within a dot row, by virtue of individual machining to achieve fine mechanical tolerances.

As a result these printers can print with all their nozzles, and with straightforward good alignment along the direction of printing-medium advance. This is true for the 7 dot/mm (180 dot/inch or "dpi") PaintJet printer, and for the 12 dot/mm (300 dpi) model 1200C printer.

It will be understood, however, that this solution to good registration is achieved only at very great cost, since the machining required is time consuming and costly. Furthermore, this solution is commercially feasible only because spacing of the dot rows at 1/7 or 1/12 mm is relatively coarse in terms of machine-tooling standards.

(c) Reserved elements—In the HP 2000C, resolution is 24 dot/mm (600 dpi) and at such fine spacings mechanical machining begins to be an uneconomic way to achieve registration. Instead, this printer uses a pen alignment scheme that reserves eight nozzles of each pen for pen-to-pen alignment.

In that system, nominally four nozzles 13K, 15K (FIG. 1) are reserved at each end of the black-ink pen K, and only the nozzles 14K between those two end zones are employed to print. Fixed upper and lower limits 11, 12 are established, reflecting these assumed reservations—and these fixed limits 11, 12 are applied to the color pens C, M, Y as well as the black pen K.

With drift away from the nominal mechanical alignment, however, for example a particular pen, e.g. the cyan pen C as shown, might be two pixel rows lower than its nominal position, and this would require use of two nozzles from the top nominal end zone. This would leave only two nozzles 13C actually reserved at the top, while in exchange the system would give up two nozzles just above the bottom nominal end zone, leaving unused six nozzles 15C as the bottom end zone. The central group of used nozzles 14C still has the same size in nozzles, but these used elements are shifted upward along the nozzle array by a distance equal to two nozzle spacings—which most commonly (though not necessarily) is two pixel rows.

In practice any such possibility may occur for any of the pens, including the black pen K or the magenta or yellow pen M, Y rather than the cyan pen C. The particular pattern illustrated, with the magenta pen M shifted upward about six rows and the yellow pen Y at the nominal position, is purely exemplary.

In any event, eight nozzles are always sacrificed to the needs of alignment, and in practice the limit lines 11, 12 are fixed in position relative to the world, or in other words to the pen carriage. The total number of nozzles in each pen is 304; therefore the maximum number of these printing elements that fall within the central regions 15 and can be used is 296.

The remaining 8/304 or about 2.7 percent of the nozzle complement is abandoned at the outset. (Of course different reserved and total numbers of nozzles may be present in different models or from different manufacturers; these values are simply exemplary.) From these numbers it can be seen that the end zones 13, 15 of all the pens have been drawn greatly exaggerated relative to the corresponding central regions 14, simply to facilitate clear discussion.

To a person not skilled in this field, such a seemingly small fraction might not appear significant. In this extremely competitive commercial environment, however, these numbers represent a major handicap—for two reasons.

(d) Direct cost—First, the provision of eight additional nozzles is far from a small matter. Each nozzle in the nozzle plate is not merely a hole in an amorphous structure, but to the contrary must be accompanied by ink-provision and firing components within the printhead—and these facilities are fashioned in what is the equivalent of a multilayer silicon circuit chip.

The cost of printed-circuits and the like formed in silicon is notoriously expensive, to the extent that common slang in industry refers to silicon "real estate". In addition, the cost of expanding the amount of space used in such a structure is not even linear: the bigger the chip, the more expensive per unit area because of the greater difficulty of working larger chips and the progressively escalating scrap factor.

(e) Hidden costs—The first major handicap of cost does not end there, however, for the silicon real estate carries its operating environment along with it in an ever-widening series of ripple effects. The connecting circuitry must have more contacts, and the print zone must be therefore longer and more expensive.

So must the printer chassis—and accordingly the shipping box. In turn the space and therefore the cost of shipment and inventory storage are implicated as well.

(f) Performance: speed—The second major handicap, even more severe, is reduced throughput. Since the marking-element (e.g. nozzle) array height is in a sense artificially restricted, each swath of marks is likewise restricted in height. A greater number of such swaths is therefore needed to cover any given image height (for instance, a full page) on the printing medium.

Each swath is marked in a single respective pass of the marking-element array ("pen", or printhead) across the sheet of printing medium. The amount of time required to make each pass of the marking-element array across the sheet is essentially independent of the array height.

Therefore the restricted array height can be translated into a greater number of passes per image or page, and a longer time to make those passes. In short, the number of minutes per page increases and the manufacturer's advertised page-per-minute performance figure falls.

The significance of this is well known to anyone who has ever glanced at a display of competing printers in a retail store. The number of pages printed per minute or hour is one of the two or three most heavily emphasized and most conspicuous characteristics of a desktop computer printer.

While a 2½% shift alone may not be visible in the published information, naturally several such factors from different causes do become visible and significant. Hence the importance of the eight unused nozzles in terms of performance.

The actual impact of a 2.7% loss of nozzle complement is likely to be extremely nonlinear. For example, in a two-pass printmode if a system comes up just four nozzles short, two additional entire passes must be made to complete the pattern.

At the other extreme, if a system in a two-pass mode happens to reach the end of a pattern and only needs, say, half the nozzles in the printhead for the final swath, then loss or gain of four nozzles might be entirely inconsequential. Since neither of these extreme kinds of circumstances can be predicted generally in advance, it can only be said that the number of available nozzles is very important.

In many practical cases, just a few nozzles more or less can assume a throughput importance out of all proportion to their number. This is surely true in human terms, taking into account the engineering effort regularly devoted even to merely trying to evaluate that importance.

When an overall printhead is just one-half inch tall (including any nozzles that are candidates for reservation) and the image is an integral multiple of a half inch, loss of only two or three nozzles can regularly trigger a requirement for additional passes. This is an adverse case which occurs with particular frequency—because half-inch nozzle arrays are currently in favor, and many desired images are in integral-inch (e.g., eight by ten) sizes.

(g) Performance: life—A related phenomenon is the effect on useful life of each printhead—now the number of pages that can be printed before the head wears out. This is particularly important for printheads that are refillable after the ink supply is exhausted.

When the number of swaths per page rises, the number of rows on each page that must be printed by each nozzle also rises. This means that a greater part of each nozzle's useful life must be expended on each page, and so lowers that life in terms of number of pages.

When several nozzles are worn out, the entire head must be discarded. Hence a 2½% reduction in nozzle complement translates directly into a 2½% reduction in pen life.

(h) Statistical waste—The reserved-nozzle approach to alignment is ingenious and extremely useful in comparison with machining to better than 1/24 mm. Nevertheless, as has now been shown, that approach is squeezed by two pressures: performance penalties suffered by failing to use all the silicon real estate (and its supporting installed environment) that is actually in place and paid for, and high mechanical cost of adding more capacity to compensate.

If either of these is allowed to control, however, then alignment suffers. This is a particularly acute aggravation because statistically, given the nature of tolerances and departure from nominal conditions, usually the most likely condition is the nominal one—i.e., the used nozzles being the 296 in the middle.

The least likely condition is the extreme case of the used nozzles extending all the way to one or the other end of the array. The intermediate two cases are in general of intermediate likelihood.

Hence the major fraction of the eight-nozzle sacrifice outlined above is made on behalf of a relatively minor fraction of the actually occurring cases of misalignment. To put it another way, the minimum nozzle loss is 8/304 or 2.7 percent—regardless of the actual amount of mechanical misalignment.

Every user must pay the full penalties outlined above, even though the printer owned by a representative user has an actual need for perhaps less than half of those penalties.

(i) Conclusion—These registration problems have continued to impede achievement of uniformly excellent incremental printing—at high throughput and very low cost—on all industrially important printing media. Thus important aspects of the technology used in the field of the invention remain amenable to useful refinement.

SUMMARY OF THE DISCLOSURE

In preferred embodiments of its first major independent facet or aspect, the invention is a method of printing an image from image data, using plural pens that in general are not perfectly aligned. The method includes the step of determining pen-to-pen mechanical misalignment.

It also includes the step of, based upon the determined misalignment, automatically shifting the data to compensate for at least a portion of the determined misalignment. In addition the method includes the step of automatically printing with the shifted data.

The foregoing may represent a description or definition of the first aspect or facet of the invention in its broadest or most general form. Even as couched in these broad terms, however, it can be seen that this facet of the invention importantly advances the art.

In particular, this facet of the invention obviates the need to sacrifice usable nozzles in return for alignment between pens.

Although the first major aspect of the invention thus significantly advances the art, nevertheless to optimize enjoyment of its benefits preferably the invention is practiced in conjunction with certain additional features or characteristics. In particular, preferably if the determining step establishes that the pens are aligned within a dot row, then the printing step prints without shifting the data.

Another preference is that the plural pens print respective plural kinds of ink. In this case the plural kinds of ink respectively include plural ink colors—and, still more preferably, plural ink dilutions. It is also preferable in this case that the invention be for use with a particular printing medium that is substantially insensitive to relative timing of application of the plural kinds of ink respectively.

For such sequence-sensitive inks, the ideal medium in this regard is plain paper. This preference is valid for sequence-sensitive inks generally, but in particular for inks such as typically used in inkjet photographic-quality incremental printers—and most particularly those manufactured by the Hewlett Packard Company.

Also with sequence-sensitive inks one preference is to design the shifting step to compensate for only part of the determined misalignment. In this situation it is also preferable to employ pen-nozzle selections to compensate for at least part of the rest of the misalignment. One common ramification of resorting to such nozzle selections is a small but significant loss of throughput.

On the other hand, it is also possible to configure the shifting step to compensate for all of the determined misalignment. Depending on the degree of sensitivity of the inking system to deposition sequence, this way of operating may be adequate with particular printing media—and if so then this operating mode is preferable, as it does not entail any of the throughput loss just mentioned.

In preferred embodiments of its second major independent facet or aspect, the invention is a printer for printing an image from image data. The printer includes plural printheads, each having a multiplicity of marking elements.

Each element is subject to deterioration and shortening of operable life through use, and the plural heads are subject to mechanical misalignment.

The printer also includes some means for extending the life of the marking elements—and thereby the life of the printheads. For purposes of generality and breadth in discussing the invention, these means will be called simply the "life-extending means".

The life-extending means accomplish their life-extending effect by distributing use of the marking elements over a maximum number of marking elements. The life-extending means include some means for automatically shifting the data to compensate for at least a portion of the misalignment.

The foregoing may represent a description or definition of the second aspect or facet of the invention in its broadest or most general form. Even as couched in these broad terms, however, it can be seen that this facet of the invention importantly advances the art. In particular, this second aspect of the invention helps counters the problem of limited printhead life, which of course is a concern to all users.

Although the second major aspect of the invention thus significantly advances the art, nevertheless to optimize enjoyment of its benefits preferably the invention is practiced in conjunction with certain additional features or characteristics. In particular, preferably the life-extending means further include some means for automatically determining the mechanical misalignment.

In this latter case, several valuable alternative preferences obtain. In one of these, the alignment-determining means include alignment data encoded on the pens, and some means for reading the encoded data. In another, the alignment-determining means instead include some means for using the pens to print a test pattern, and some complementary means for reading the test pattern to determine the pen alignment therefrom.

In preferred embodiments of its third major independent facet or aspect, the invention is a printer for printing an image from image data. The printer includes plural pens, each pen having multiple nozzles.

The pens in general are not perfectly aligned. The printer also includes some means for determining pen-to-pen physical misalignment.

Also included are portions of a processor programmed to automatically print the image using substantially all of the multiple nozzles of all of the pens. The processor is programmed to take into account the determined alignment.

The foregoing may represent a description or definition of the third aspect or facet of the invention in its broadest or most general form. Even as couched in these broad terms, however, it can be seen that this facet of the invention importantly advances the art.

In particular this third aspect of the invention, like the first, in suitable circumstances eliminates the alignment-driven need for discarding a significant part of the nozzle complement. This is a significant advance, because nozzle "real estate" —and corresponding capacity on the underlying silicon chip used for firing control—are limiting factors in the cost of inkjet pens.

Although the third major aspect of the invention thus significantly advances the art, nevertheless to optimize enjoyment of its benefits preferably the invention is practiced in conjunction with certain additional features or characteristics. In particular, preferably the processor portions are programmed to provide a relative shift of data for the plural pens, to compensate for imperfect alignment of the pens.

In this case ordinarily the physical misalignment includes relative displacement of the pens toward lower or higher positions. A corresponding preference is that the data shift include raising data for a lowest pen or lowering data for a highest pen, or both.

Another preference is that the determining means include alignment data encoded on the pens, and some means for reading the encoded data. In this case the determining means preferably further include carriage datum-point alignment calibration data ascertained at manufacture of the apparatus, and portions of a processor programmed to automatically take into account the carriage datum-point alignment calibration data.

Yet another preference is that the determining means include some means for using the pens to print a test pattern. This preference also includes provision of corresponding means for reading the test pattern, to determine the pen alignment from the read pattern.

Alternative preferences in this regard include using the pens to eject drops, under automatic processor control, and a drop detector to determine their location. For example a shutter and optical sensor may preferably serve as such a detector.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

1. The Data-shift Approach

Figure 1:
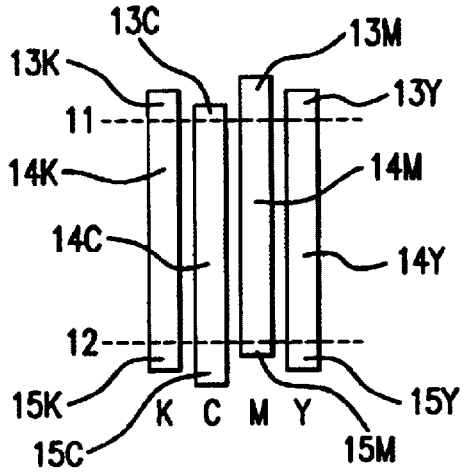
FIG.1 PRIOR ART
FIG. 1 is a diagram of a representative group of pens with representative mechanical misalignments (greatly exaggerated for clarity), and masked off to obtain effective alignment by reservation of nozzles according to the prior-art scheme discussed above.

In one novel system and method, no nozzles at all are reserved. The top ends 21 (FIG. 2) of the used-nozzle sections 24, for the same exemplary pen misalignment pattern as illustrated and discussed earlier for the prior art, are no longer at a common level (as at 11, FIG. 1).

Rather, the top ends 21K, 21C, 21M, 21Y are independent of one another and coincide with the extreme top ends of the overall nozzle arrays K, C, M, Y. In general the top ends 21K, 21C, 21M, 21Y of the used-nozzle sections can be at four different positions, but naturally they can also be aligned—as is the case for the black and yellow pens K, Y in the illustration—if the pens themselves happen to be aligned.

Analogous relationships hold for the bottom ends 22K, 22C, 22M, 22Y of the used-nozzle sections. Those sections themselves 24K, 24C, 24M, 24Y thus occupy the entire arrays, enabling complete elimination of the 2.7 percent, eight-nozzle waste for the exemplary system.

To make these improvements possible, for each color the image data are shifted with respect to the corresponding pen, independently—to compensate for the misalignment. For each color the selection of data for use in each swath is also similarly shifted.

Preliminarily, consider the relationships between the black and cyan image data 36K, 36C (FIG. 4) for the prior-art reserved-nozzle system. In that prior-art system and method, all four image-data sets are considered to be aligned. This is shown exemplarily for the black and cyan planes 36K, 36C only, the other two data sets (not shown) for magenta and yellow being identical in both size and position.

The data subsets 37K, 37C for any given swath, too, are likewise aligned, as is the case for the other two corresponding data subsets (not shown) for magenta and yellow. Thus the top edges of the two representative data subsets 37K, 37C have a common level 11, and the bottom edges too have a common level 12—these being the same artificially imposed top and bottom common cutoff points 11, 12 identified in FIG. 1 and the earlier discussion.

Figure 2:
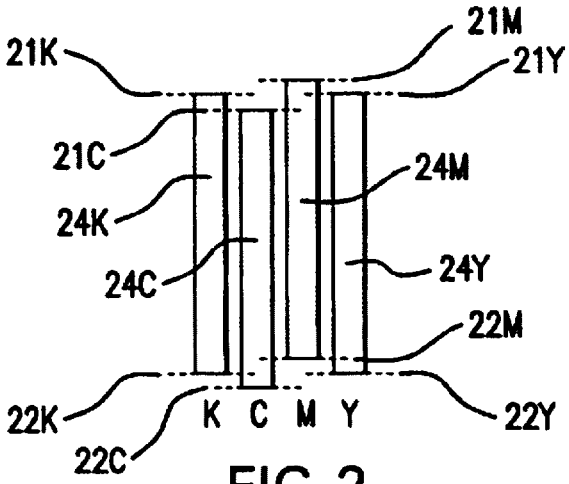
FIG. 2 is a like diagram of a novel system and method that maximize throughput while maintaining effective interpen alignment by shifting image data, to print with physically unaligned nozzles.

In the novel system of FIG. 2, by comparison, the cyan data for transmission to the pen in each swath must be higher, by the same distance that the cyan pen itself is lower. It is necessary that every original pixel row of cyan data must align, on the printing medium, with the original corresponding pixel row of black data. Since the pens are misaligned, all the data must be oppositely misaligned to compensate.

This is accomplished by shifting the cyan data 38C as they are to be fed (FIG. 5) to the cyan pen C, in the opposite direction from the unintended shifting of that pen itself. Hence, when the cyan pen C is lower than the black pen K by some amount illustrated in FIGS. 1 and 2, the going-to-the-pen cyan data 38C must be higher than the black data 38K by an equal but opposite offset 39.

This shift completely corrects for data misalignment so that when the deposited cyan data 38C' are considered, i.e. the cyan markings as they are printed on the printing medium, the downward pen shift and upward data shift cancel out. The cyan data 38C' therefore appear on the printing medium in register with the corresponding black data 38C.

Figure 4:
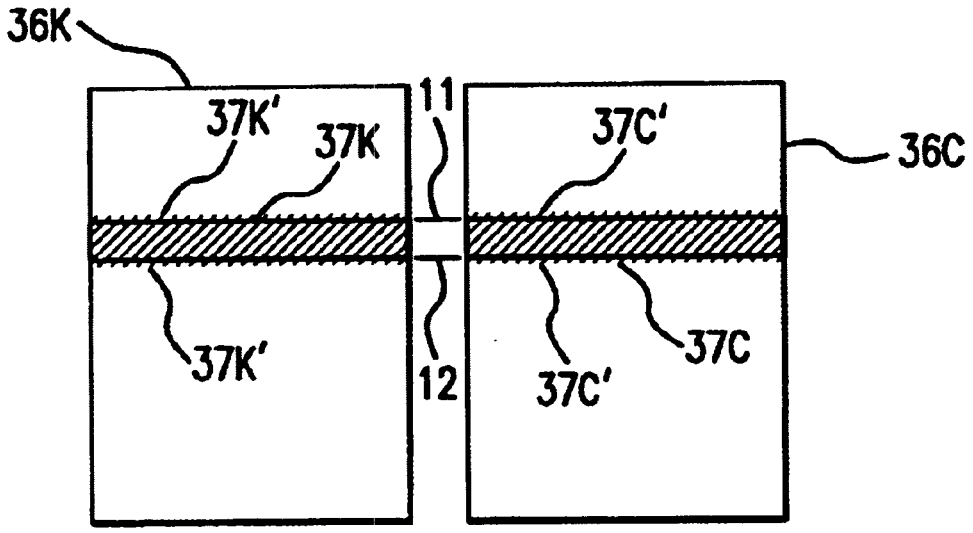
FIG. 4 is a like diagram of the overall data sets for two colors of an entire image, and also showing the data subsets automatically chosen for a particular swath in both the FIG. 1 prior-art system and FIG. 3 novel system.
Figure 5:
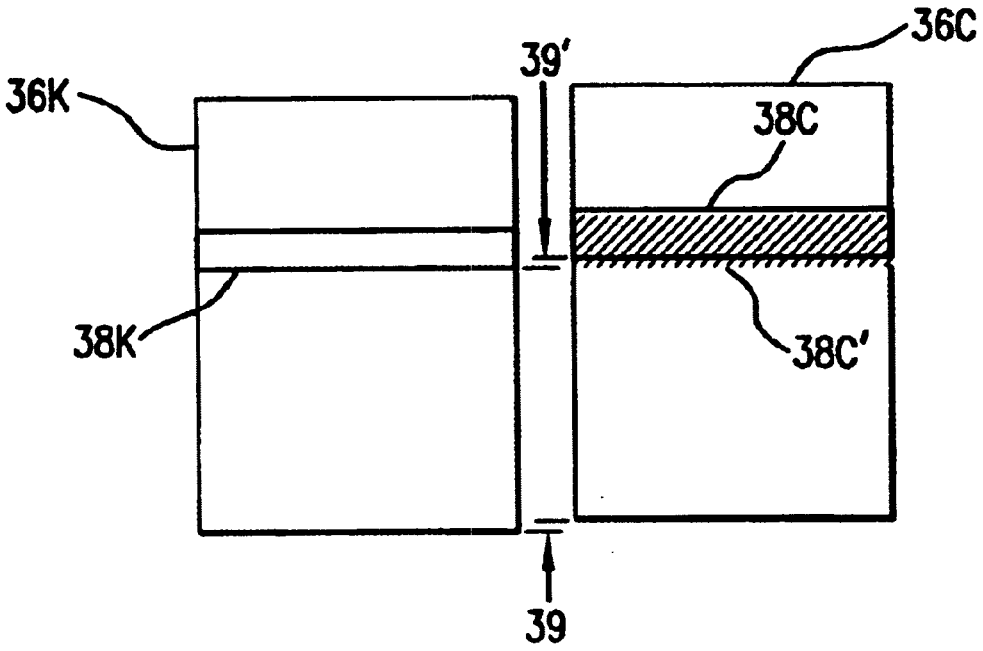
FIG. 5 is a like diagram of overall data sets and swath subsets according to the FIG. 2 novel system.

As FIGS. 4 and 5 confirm, each swath being printed is significantly taller than the corresponding height in the reserved-nozzle approach. (Again, the improvement is exaggerated for clarity of illustration.)

The data-shift approach requires reevaluation of the necessary synchronizing data-shift distances whenever any of the pens is replaced, but only for that particular pen. Hence the necessary measurements or determinations, and corresponding calculations, need not be performed for every image or page, or even each time the printer is turned on, but only on occasions that—for most users—occur very infrequently.

2. Limitations of the Data-shift Approach

What can cause problems, however, is that deposition order of different colors, within the few pixel rows of data shift along the tops or bottoms of swaths, is now different from the normal deposition order. The result can be noticeable hue or saturation shifts, or other inking peculiarities of sheen etc., in these shallow bordering regions.

For example, in the example of FIG. 5 the solid-outline portion of cyan data 38C that is above (i.e. outside) the hatched portion of cyan swath 38C' is correctly positioned relative to (namely, above) the top of black swath 38K. It is not, however, printed in the same pass as that black swath 38K—as it would be in the conventional approach.

Instead it is printed in the preceding pass. Reversal of color deposition order will occur in such regions—or in analogous regions below the bottoms of the original swaths, depending on the order of the pens on the carriage and the order of carriage motion.

Where hue or analogous shifts happen to be conspicuous, within the context of subject matter in a particular color image, distinct banding artifacts can appear in the image. Accordingly it is important to determine the conditions under which such shifts are noticeable.

For the product example discussed above, it has been observed that hue shifts and related phenomena are insignificant when printing on plain paper. For other types of printing medium such as special glossy media, transparencies, or other plastic media, however, in general these color effects are objectionable and this novel system and method are usually best avoided.

Again, these statements are true for the particular printing medium under discussion. Results should be tested for each new product environment, printing medium, and other major variation of operating conditions which is contemplated.

3. The Adaptive Approach

For such circumstances in which the data-shift method is not acceptable, or more generally whenever preferred, another novel method and system can be used instead. This alternative is not sensitive to deposition sequence, but compared with data shift does not produce as great a benefit—or in fact as consistent a benefit—in terms of saved pixel rows per pass.

This second novel approach proceeds according to a principle of using all the commonly aligned nozzles that are available for each actual multipen set in each actual printer. This principle replaces the earlier philosophy of establishing a simple, common and consistent nozzle complement for all pens and all printers.

As will be recalled, in the data-shift approach the top end 21 of the usable portion 24 of every pen K, C, M, Y is actually at the top end of that respective pen itself. In the second novel approach, that condition cannot be met for every pen, but in general can be provided for at least one pen—namely, the pen (C in the FIG. 3 example) which is lowest.

Thus the top end 31 (FIG. 3) of the usable portion 34C of the lowest pen, here the cyan pen C, is at the overall top end of that cyan pen. In other words, for that pen no nozzle is sacrificed to alignment. The top ends 31 of the usable portions of the other three pens K, M, Y are defined by the top end of the cyan pen C, so that the top ends 31 of the usable portions of all four pens are coincident.

If more than one pen is aligned at the lowest possible position, then the top conditions just described can be satisfied for all those pens which have that alignment. This is so even if all four pens are aligned together.

Analogously the bottom ends 32 of the usable portions of all four pens C, M, Y, K are defined in common by the bottom end of the pen which is highest—here the magenta pen M. No nozzle is sacrificed for alignment at the bottom of the magenta pen, and the usable portion 34M of that pen coincides with the overall bottom end of that magenta pen M.

Also analogously with the top-end conditions, the bottom-end conditions just described can be met by whatever number of the four pens have the same highest alignment in common. This is true even if the four pens are all aligned in common at the highest position.

Figure 3:
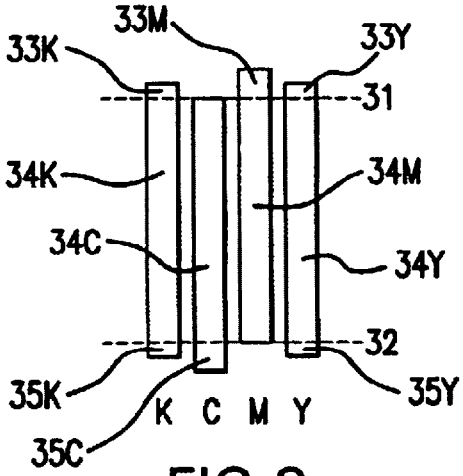
FIG. 3 is a like diagram of another novel system and method that employ an adaptive printing mode to maximize throughput while maintaining interpen alignment by nozzle selection, or in other words partial reservation of nozzles, but without shifting the data.

In the latter case there is no misalignment at all, and the entire height of every pen becomes the common usable portion 34K, 34C, 34M, 34Y. This condition is illustrated in FIG. 3 in the sense that the general showing of endzones 32K, 32M, 32Y, 34K, 34C, 34Y encompasses every possible endzone height from eight nozzles down through zero inclusive.

Now it can be appreciated that the usable portions 34 of the four pens K, C, M, Y extend from the top 31 of the lowest pen C down to the bottom of the highest pen M. To the extent that the lowest and highest pens e.g. C, M are not perfectly aligned, bottom and top endzone portions 32C of the lowest pen and 31M of the highest pen, respectively, are sacrificed to obtain useful effective alignment.

To the extent that only one pen C is lowest and only one pen M is highest, both the top and the bottom endzone portions 31K, 31Y, 32K, 32Y of the other two pens too are sacrificed. In short, this approach adapts the effective height of the nozzle array to the common available nozzles in the four pens, which is controlled by interpen alignment—hence the phrase "adaptive printing mode".

4. Benefits and Limitations of the Adaptive Approach

A merit of this approach is that every printer, taking into account the particular printheads that are installed, and their relative alignments, receives the maximum possible usable nozzle-array height 34. As FIG. 3 shows, the usable portion cannot be extended further upward—because in that direction there is no additional usable nozzle of the lowest pen C—and conversely for extension downward, with respect to the bottom-most usable nozzle of the highest pen M.

As this approach requires no data shift, FIG. 5 is not applicable. The illustration of FIG. 4, however, includes an indication of the data effects of this second novel approach: each adaptive-mode swath 37K', 37C' etc. (drawn hatched in FIG. 4) is in general taller than the corresponding prior-art swath 37K, 37C etc.

These swath heights, however, are not consistent among printers, or even among different pen combinations in any given printer, for they depend upon the uncontrolled variations of pen alignment as explained above. These swath heights vary within a range between the same, restricted height of the prior-art swaths 37K, 37C—as a minimum—and the unrestricted height 38K, 38C of the data-shift method as a maximum.

A drawback of this adaptive approach is that printmasking must vary with the number of nozzles actually available in common on the pens in use. Since pens are replaced from time to time in nearly every printer, the programmed processor that operates the printer must be capable of selecting or generating suitable printmask sets to match the pen set currently installed.

This requirement is not unduly complex. As mentioned at the outset, it is merely at the threshold of printmode techniques.

Still, this requirement in general may require more printmask storage capacity, if the printer relies upon masks provided at the factory—or more computing power, in the case of masking generated by the printer itself. This topic of required storage or power is potentially very wide-ranging because in some printers the printmask used is very small and is tiled over the image, and even some relatively complicated masks though relatively wide are not very tall, etc. Furthermore some infrastructure of hardware and software, or printer architecture, must be present anyway.

Nevertheless it remains generally true that storing or being able to generate several different masks, for use whenever the invention calls for different swath heights, can sometimes add to the overall required silicon-chip size in a printer. Such requirements should be taken into consideration.

Although the art of printmask generation as such continues to be subject to ongoing refinement and important advances, variation of masks with swath height is well understood and is generally independent of the method used for generating the masks. Therefore implementation of this second novel nozzle-saving approach is well within the state of the art as to needed accommodations in print-masking.

5. Hardware

The present invention is embodied in, for example, incremental printers of the thermal-inkjet type. Such printers have been disclosed and illustrated in many patent documents coowned with the present document, and in many others; accordingly, general information about such devices need not be repeated here.

Hardware for implementing the novel approaches outlined above include, first, the generally misaligned pens or printheads K, C, M, Y (FIG. 6), each with their respective arrays of nozzles or printing elements 41. Also required is provision for determining relative alignment or misalignment of the pens and their element arrays, and this provision can take any of several different forms.

One example of such provision is encoded information 42 associated with each pen, conveying the alignment information—in combination with one or more readers 43 for reading the information 42 from the pens. Thus for instance the information may be simply printed in ordinary numerical form 42 on the pen, and the readers may be optical numeral readers 43 disposed or moved to read those numerals.

Alternatively the indicia may be in bar-code form 42 and the readers optical bar-code readers 43, or the indicia may be magnetically impressed on a magnetic element 42 affixed to the pens and the reader may be a magnetic-strip reader 43. Any of such systems in the aggregate make up a first type of alignment-determining means 44A; these means cooperate with reader-control portions 42 of a programmed processor 51, in collecting the alignment information to a data path 61 where it can be received in a final printing control block 55 of the processor 51.

When this type of determining means 44A is used, it may also be desirable or necessary to include auxiliary provision for taking into account possible misalignment contributions 81 from the alignment datum points 82–85 that locate the printheads K, C, M, Y in the carriage bays 72–75, and move those heads across the printing medium. (For definiteness the datum points 82–85 are illustrated as discrete pads, although in practice they may be merely surfaces of the respective bays 72–75.)

Such auxiliary provision may take the form of misalignment measurement data 81 recorded at the factory and deposited in electronic storage 76 that is part of or otherwise associated with the programmed processor 51 mentioned earlier. At printing time the processor interrelates these locating-datum alignment data 81 with the pen alignment data 42 encoded on the pens K, C, M, Y and recovered through the readers 43 as mentioned above—all information from the print engine 70—to generate overall comparative alignment information for use in one or the other of the novel approaches introduced above.

Figure 6:
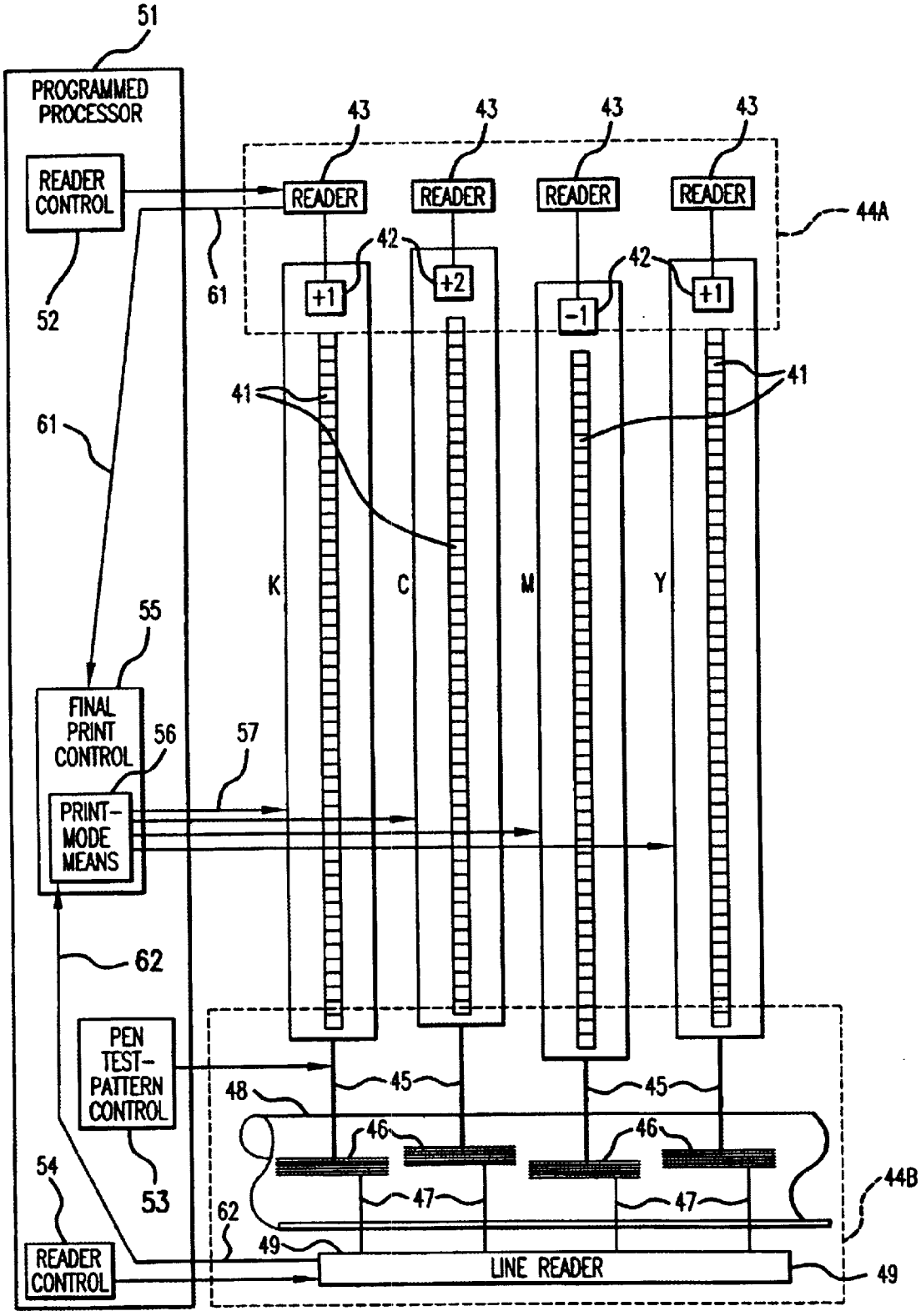
FIG. 6 is a block-diagrammatic representation of a hardware system according to the FIG. 2 or 3 operation.
Figure 8:
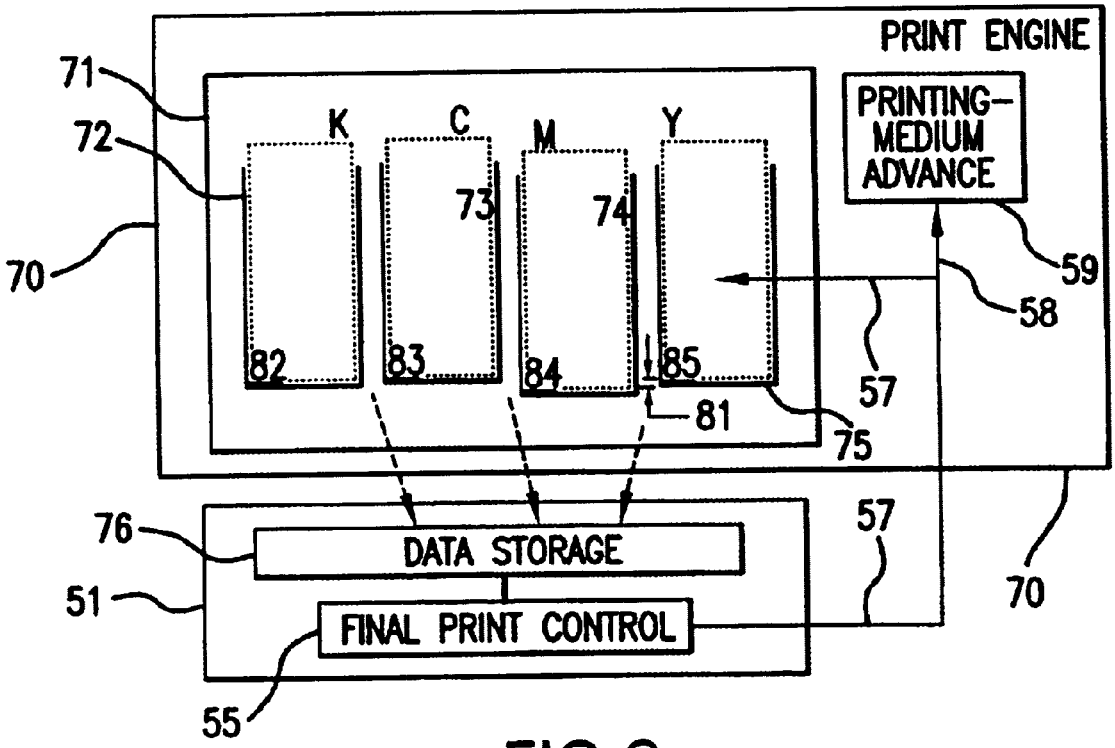
FIG. 8 is a further elaboration of another portion of the FIG. 6 system, namely provision for incorporating carriage-bay misalignment information into the encoded-pen form of the alignment-determining means.
Figure 9:
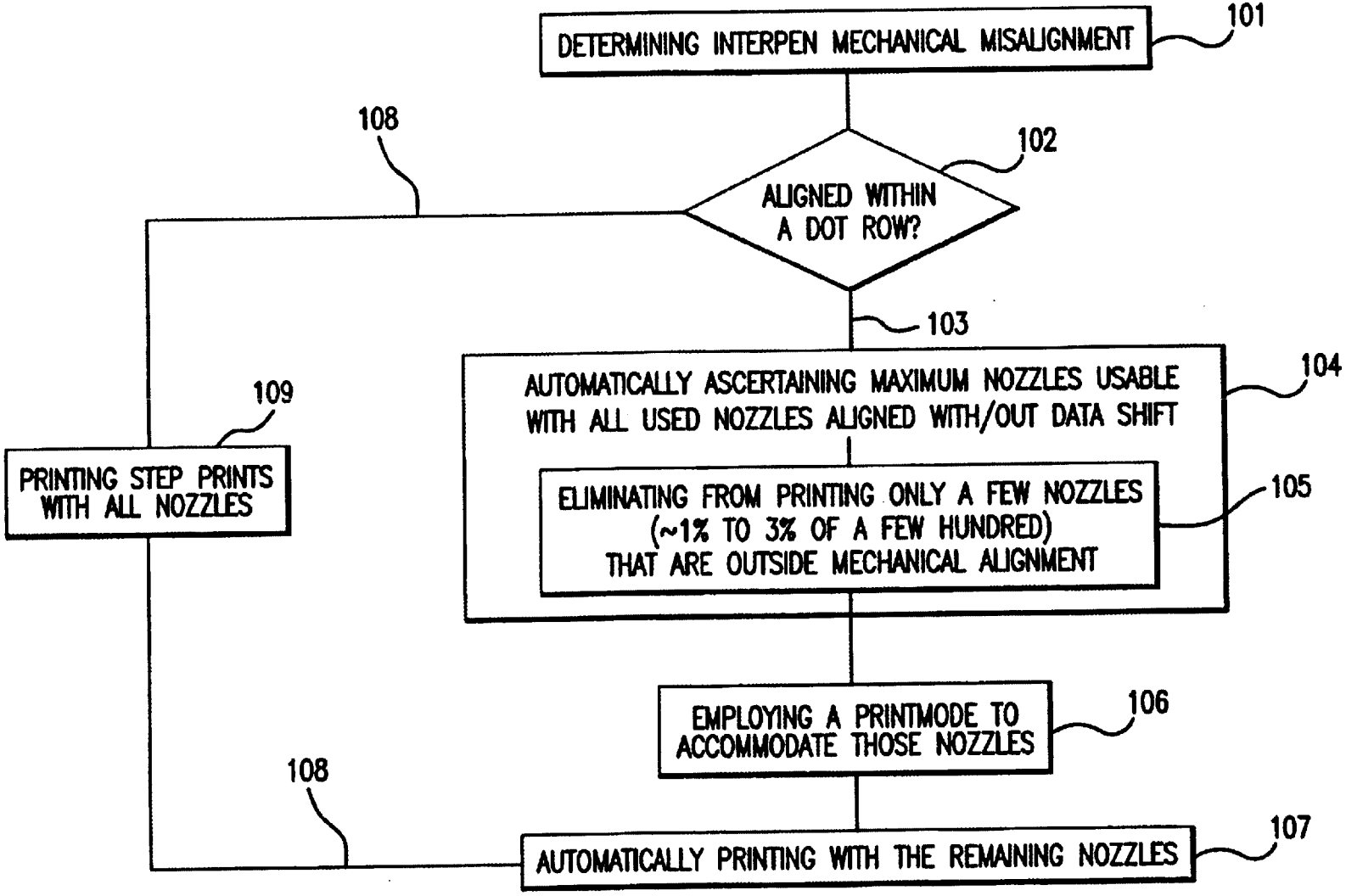
FIG. 9 is a flow chart showing method aspects of the FIG. 2 or 3 operation.

Using this overall information, the processor 51 develops or implements printmode details which eventuate as control signals 57, 58 (FIGS. 6 and 8). These signals pass back into the print engine 70 for firing the pens and operating the printing-medium advance mechanism 59.

A different strategy for determining alignment generates information in real time, rather than through factory measurements and encoding. This strategy may be effected by portions 53 of the processor 51, programmed to control firing 45 of the pens K, C, M, Y to mark test patterns 46 onto a printing medium 48. The hardware implementing this strategy makes up alternative alignment-determining means 44B (FIG. 6).

Other portions 54 of the processor 51 operate one or more line readers 49, which optically sense details of the test patterns 46—to generate corresponding detector signals 62 that in turn pass to the print-control block 55. The test patterns 46 can be designed and the signals 62 interpreted in the ways taught by U.S. Pat. No. 5,600,350 to Cobbs et al., U.S. Pat. No. 5,796,414 to Sievert et al., and U.S. Pat. No. 5,980,016 to Nelson et al.—all three coowned with the present document.

Figure 7:
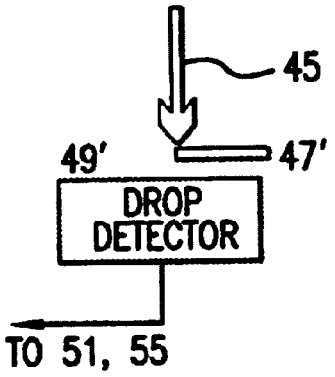
FIG. 7 is a like representation of an alternative form of a portion of the FIG. 6 system, namely a drop-detector form of the alignment-determining means.

An alternative to the test patterns 46 and line sensors 49 as such is a combination of shutter 47' (FIG. 7) and drop detector 49'. These receive the inkdrop stream 45 and in response generate corresponding alignment data for passage to the print-control block 55 within the processor 51.

The alignment information obtained in any of these real-time, inking-measurement strategies is used substantially as in the encoded-data strategy. Here, however, it is not necessary to correct for misalignment of the carriage-bay datum points 72–75.

Whatever alignment-determining strategy is employed, the resulting computations within the final printing-control block 55 are used in a printmasking subblock to generate the final firing-control signals 57, 58 (FIG. 6 and 8). These signals operate the pens and printing-medium advance mechanism in the print engine 70, to print the desired image.

6. Printhead Life Extension

Both the data-shift and the adaptive approaches have benefits other than greater throughput. In particular they have the effect of allocating or distributing the printing work over a larger number of marking elements, e.g. nozzles—and thereby extending the life of those elements.

Accordingly the several portions of the apparatus (FIGS. 6 through 8) illustrated and discussed above function as means for extending the life of the marking elements and thereby the life of the printheads, by distributing use of the marking elements over a maximum number of marking elements.

Thus the life-extending means include means 44A, 44B, 47', 49', 52–54, for printing with the maximum number of nozzles that can be used while printing with the used nozzles of all pens substantially aligned—whether by data shift or by adaptation. They print in this way based on known pen-to-pen mechanical misalignment.

In the case of the adaptive approach, this is accomplished substantially without relative shift of respective data for the plural pens. The life-extending means further include the means for automatically establishing the mechanical misalignment.

7. Method

From the foregoing, those skilled in the art will understand the method as well as the apparatus aspects of the invention. For completeness FIG. 8 shows representative program flow for practice of the method aspects of the invention.

This flow chart will be essentially self explanatory in its presentation of the determining or establishing step 101, a query step 102 that leads to branching 103/108 and eventually printing 107 with the nozzles available under the particular novel approach selected. The automatic ascertaining step 104 displays the disjunctive condition "with/out data shift"—meaning that the indicated ascertaining is performed under the assumption that:

(1) there is data shift, for the data-shift approach; or (2) there is not data shift, for the adaptive approach.

The ascertaining step includes a nozzle-elimination substep 105 as shown. The printmode-using step 106, as mentioned earlier, although novel in the sense that it is first used in the novel approaches described above, is entirely straightforward and well within the state of the printmode or printmasking art. It entails simply preparing one or more printmasks suited to the known, to-be-used height of the marking-element array, and in the case of the data-shift approach also incorporating the simple data shifts previously described.

The above disclosure is intended as merely exemplary, and not to limit the scope of the invention—which is to be determined by reference to the appended claims.

What is claimed is:

1. A method of printing an image from image data, using two pens that in general are not perfectly aligned along a printing-medium advance direction, wherein said two pens are not necessarily the only operating pens present; said method comprising the steps of:

determining pen-to-pen mechanical misalignment between said two pens, along the advance direction;

based on the determined misalignment, automatically shifting the image data along the advance direction to compensate for at least a portion of the determined misalignment between said two pens;

refraining from use of nozzle reservation for accommodating all of the determined misalignment between said two pens; and automatically printing with the shifted data.

2. The method of claim 1, wherein:

if the determining step establishes that the pens are aligned within a dot row, then the printing step prints without shifting the data along the advance direction.

3. The method of claim 1, wherein:

said plural pens print respective plural kinds of ink.

4. The method of claim 3:

wherein said plural kinds of ink comprise plural ink colors respectively; and further comprising the step of avoiding color artifacts due to said shifting and refraining steps, by a combination of the steps of:

providing such printing medium that is substantially insensitive to relative timing of application of the plural colors respectively; and restricting the shifting step to compensation for only part of the determined misalignment along the advance direction.

5. The method of claim 3:

wherein said plural kinds of ink comprise plural ink dilutions respectively; and further comprising the step of avoiding tonal artifacts due to said shifting and refraining steps, by a combination of the steps of:

providing such printing medium that is substantially insensitive to relative timing of application of the plural dilutions respectively; and restricting the shifting step to compensation for only part of the determined misalignment along the advance direction.

6. The method of claim 3, for use in printing said image onto a particular printing medium; and further comprising the step of:

avoiding color or tonal artifacts due to said shifting and refraining steps, by providing such printing medium that is substantially insensitive to relative timing of application of the plural kinds of ink respectively.

7. The method of claim 6, wherein:

the printing medium is plain paper.

8. The method of claim 3, for use in printing said image onto a particular printing medium; and wherein:

the printing medium is sensitive to relative timing of application of the plural kinds of ink respectively; and avoiding color or tonal artifacts due to said shifting and refraining steps, by restricting the shifting step to compensation for only part of the determined misalignment along the advance direction.

9. The method of claim 8, further comprising the step of:

employing pen-nozzle selections to compensate for at least part of a remainder of the determined misalignment along the advance direction.

10. The method of claim 1, wherein:

the shifting step compensates for substantially all of the determined misalignment along the advance direction.

11. The method of claim 1, wherein:

before said shifting step, some of the image data are naturally allocated to printing in a particular pass; and the shifting step comprises reallocating said some of the image data to printing in a different pass.

12. A method of printing an image from image data, using plural pens that in general are not perfectly aligned along a printing-medium advance direction; said method comprising the steps of:

determining pen-to-pen mechanical misalignment along the advance direction;

based on the determined misalignment, automatically shifting the image data along the advance direction to compensate for at least a portion of the determined misalignment; and automatically printing with said shifted data; and wherein:

before said shifting step, some of the image data are allocated to printing in a particular pass; and the shifting step comprises reallocating said some of the image data to printing in a different pass.

13. The method of claim 12, wherein:

if the determining step establishes that the pens are aligned within a dot row, then the printing step prints with zero shifting of image data along the advance direction.

14. The method of claim 12, wherein:

said plural pens print respective plural kinds of ink.

15. The method of claim 14, wherein said plural kinds of ink comprise plural ink colors respectively.

16. The method of claim a 15, further comprising the step of:

avoiding color artifacts due to said shifting and reallocating, by a combination of the substeps of:

providing such printing medium that is substantially insensitive to relative timing of application of the plural colors respectively; and restricting the shifting step to compensation for only part of the determined misalignment along the advance direction, so as to minimize said reallocating.

17. The method of claim 14:

wherein said plural kinds of ink comprise plural ink dilutions respectively.

18. The method of claim 17, further comprising the step of:

avoiding tonal artifacts due to said shifting and reallocating, by a combination of the substeps of:

providing such printing medium that is substantially insensitive to relative timing of application of the plural dilutions respectively; and restricting the shifting step to compensation for only part of the determined misalignment along the advance direction, so as to minimize said reallocating.

19. The method of claim 14, for use in printing said image onto a particular printing medium; and further comprising the step of:

avoiding color or tonal artifacts due to said shifting and reallocating, by providing such printing medium that is substantially insensitive to relative timing of application of the plural kinds of ink respectively.

20. The method of claim 19, wherein:

the printing medium is plain paper.

21. The method of claim 14, for use in printing said image onto a particular printing medium; and:

wherein the printing medium is sensitive to relative timing of application of the plural kinds of ink respectively; and further comprising the step of avoiding color or tonal artifacts due to said shifting and reallocating, by restricting the shifting step to compensation for only part of the determined misalignment along the advance direction, so as to minimize said reallocating.

22. The method of claim 21, further comprising the step of:

employing pen-nozzle selections to compensate for at least part of a remainder of the determined misalignment along the advance direction.

23. The method of claim 12, wherein:

the shifting step compensates for substantially all of the determined misalignment along the advance direction.

* * * * *